US005430254A

United States Patent [19]

Loeb et al.

[11] Patent Number: 5,430,254

[45] Date of Patent: Jul. 4, 1995

[54] REVERSE CRIMP CONNECTOR

[75] Inventors: Gerald E. Loeb; Raymond A. Peck, both of Kingston, Canada

[73] Assignee: Queen's University, Kingston, Canada

[21] Appl. No.: 121,097

[22] Filed: Sep. 15, 1993

[51] Int. Cl.[6] ..... H01R 4/10; H01R 43/04

[52] U.S. Cl. ..... 174/84 C; 29/857; 29/861; 174/94 R; 439/863; 439/879

[58] Field of Search ..... 174/84 C, 94 R; 439/387, 863, 879, 877; 29/857, 861

[56] References Cited

U.S. PATENT DOCUMENTS

| | | | |
|---|---|---|---|
| 3,391,375 | 7/1968 | Richards | 439/863 |
| 3,600,501 | 8/1971 | Crimmins | 174/94 R |
| 3,605,079 | 9/1971 | Werr | 174/87 |
| 3,611,563 | 10/1971 | O'Loughlin | 29/461 |
| 3,668,301 | 6/1972 | Faulconer | 174/88 R |
| 3,697,669 | 10/1972 | O'Loughlin et al. | 174/84 R |
| 3,744,006 | 7/1973 | O'Loughlin | 439/393 |
| 3,818,415 | 6/1974 | Evans et al. | 439/393 |
| 3,897,992 | 8/1975 | Weidler | 174/84 C |
| 3,906,623 | 9/1975 | Clabburn et al. | 174/94 R |
| 4,123,133 | 10/1978 | Pickett et al. | 439/863 |
| 4,468,083 | 8/1984 | Lee et al. | 439/730 |
| 4,478,475 | 10/1984 | Tullin | 29/857 |
| 4,687,273 | 8/1987 | Pranch | 439/411 |
| 4,828,351 | 5/1989 | Beinhaur | 385/76 |
| 4,829,668 | 5/1989 | Brandeau | 29/861 |
| 5,118,313 | 6/1992 | Delalle | 439/730 |

FOREIGN PATENT DOCUMENTS

| | | | |
|---|---|---|---|
| 1935373 | 7/1969 | Germany . | |
| 1432589 | 4/1976 | United Kingdom | 439/863 |
| 1543530 | 2/1990 | U.S.S.R. . | |

*Primary Examiner*—Morris H. Nimmo
*Attorney, Agent, or Firm*—Richard J. Hicks

[57] ABSTRACT

A self crimping connector for securing very fine wires of the order of 0.0015" diameter into an electrical connector is described. A terminal block having an opening at least five times the diameter of the wire is preferably gold plated and the wire is inserted. A malleable metal pin means, preferably a gold pin having a diameter slightly less than the diameter of the opening, is inserted between the wire and a sidewall of the opening. A longitudinal force is applied to the exposed end of the pin so as to radially expand the pin and force it into locking engagement with the wire and the sidewall without deforming or nicking the wire and thus weakening it.

18 Claims, 1 Drawing Sheet

REVERSE CRIMP CONNECTOR

FIELD OF INVENTION

This invention relates to a self crimping connector for securing extremely fine wires and the like in electrical contact to a receptacle therefor.

BACKGROUND OF INVENTION

There are many situations, particularly in biomedical devices, where it is necessary to make an electrical connection between an extremely fine gauge wire (of the order of 0.0015" diameter) and a connector assembly in which the usual soldering technique for electrical connection is inappropriate for any one of a number of reasons. The wires may be made of an alloy which is not wetted by solder, or from an alloy that melts at soldering temperatures or dissolves into the solder. The connection may be implanted in the body or exposed to water vapour which will result in solder corrosion, possible electromechanical failure or heavy metal poisoning. The insulation on the wires may melt or the spacing between the connections or access to them is too restricted to apply solder and a hot iron. Mechanical crimping is the usual alternative, but this too has its limitations. Special materials and/or tools may be required and access space for those tools may be too limited. Crimping may also impose mechanical stress or distortion on the wire predisposing it to failure at the crimp site. Reverse crimping is one solution and attention is directed to U.S. Pat. Nos. 4,828,351 and 3,600,501 which describe connectors in which cylindrical powdered or sintered metal inserts are inserted into the connector hole and the wire to be attached is axially inserted into the insert. A longitudinal force is then applied to the insert in order to expand it radially and thus secure the wire to the connector. When dealing, however, with wires of the order of 0.0015" diameter, or something less than the diameter of a human hair, it is extremely difficult to thread the wire through the axial bore of an insert. It is also extremely difficult to radially expand an insert of the required diameter without damaging the wire. Methods descrbed in the prior art require several complex components and mechanical fixtures and appliances that are difficult to fabricate and to use when working at this fine scale. There is, therefore, a need for an alternative "reverse-crimp" method for securing very fine wires into a connector, particularly for use in implantable devices such as a chchlear prosthesis and the like.

OBJECT OF THE INVENTION

An object of the present invention is to provide a reverse crimp electrical connector which is suitable for electrically and mechanically securing wires of less than 0.003" in diameter.

Another object of this invention is to provide a method for making a crimp connection to wires less than 0.003" diameter in an electrical connector.

BRIEF STATEMENT OF INVENTION

Thus, by one aspect of this invention there is provided a system for securing very fine wires in electrical contact with a terminal means comprising:

a substantially rigid terminal means having an opening adapted to receive at least one fine wire for securement therein; and a malleable pin means adapted for insertion into said opening between a side wall thereof and said fine wire, whereby when a longitudinal force is applied to one end of said pin means radial expansion thereof occurs so as to secure said fine wire in electrical contact with said sidewall of said terminal means.

By another aspect of this invention there is provided a method for securing a wire less than 0.003" in diameter in electrical contact with a terminal means, comprising;

(a) providing a terminal means having an opening therein of at least five times the diameter of said wire;

(b) inserting said wire into said opening;

(c) inserting a malleable pin means in said opening between a sidewall thereof and said wire; and (d) applying longitudinal pressure on one end of said pin means so as to radially expand said pin means into locking electrical and mechanical engagement with said wire and said sidewall and thereby secure said wire in said terminal means.

DETAILED DESCRIPTION OF PREFERRED EMBODIMENTS

Figure 1:
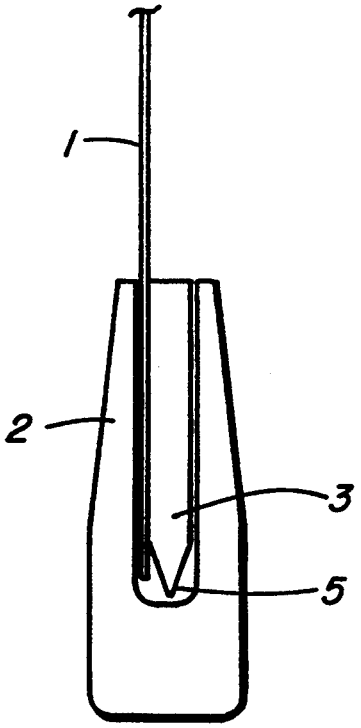
FIG. 1 is a cross sectional view of the connector of the present invention showing placement of the crimping pin.
Figure 2:
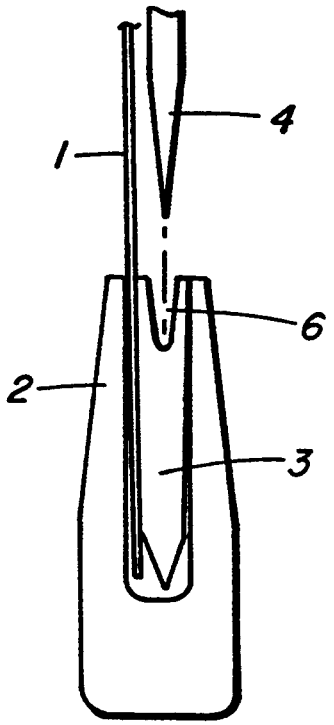
FIG. 2 is a cross sectional view similar to FIG. 1 showing the application of the crimping force.

In the production of cochlea prosthetic implants, for example, it is necessary to secure up to about 14 wires individually to a terminal block of extremely small size. The wires are usually, but not essentially, platinum-iridium of the order of 0.0015" diameter which are individually received in a gold plated "pot" or receptacle which is of the order of 0.020" diameter and 0.045" deep. As seen more clearly in FIG. 1, a soft gold pin 3, approximately 0.017" in diameter and 0.045" long which is cut from a length of gold wire, is inserted alongside wire 1 in port 2. As seen in FIG. 2, pin 3 is deformed laterally so as to squeeze the fine wire 1 between the pin 3 and pot 2, by pushing a hard sharp needle 4 on the head of pin 3 using hand pressure. The small, wedge shape of the needle provides very high pressure concentrations with modest force from the operator, resulting in general deformation which provides a high surface area of contact with both the pot 2 and wire 1.

In a preferred embodiment, the gold pin 3 may be preformed to have a pointed end 5 to facilitate insertion into pot 2. Optionally, the pin 3 may also have a recessed end 6 to facilitate centering of the crimping needle 4.

While this invention has been described with particular reference to platinum-iridium wires and gold pins, it will be appreciated that other types of fine wire are also contemplated and that the pins can be made of any malleable noble metal including gold, silver and platinum.

The present invention can be used with any conventional solder-pot termination on commercial connectors and can be used in very close quarters on small, closely-spaced pins. The mechanical force required is minimal and no heat is required to produce a relatively uniformly distributed force on the fine wire, thus avoiding nicks and crimps that might weaken it. When the present invention is used with wires made from a material that tends to form a non-conductive surface oxide, it may be desirable for the inside surface of the solder pot to have ridges, threads or abrasive surface texturing so that the surface oxide will be scrubbed from the wire's surface as the wire is compressed and deformed against the walls of the receptacle.

The present invention may be used in an automated or semi-automated mode in which connections are made simultaneously between a multiplicity of wires and their corresponding receptacles by the application of a comb-shaped array of needles whose spacing corresponds to the spacing between the various receptacles. This embodiment may be particularly useful for working with ribbon cables in which multiple individual conductors are arranged in parallel.

We claim:

1. A system for securing very fine wires in electrical contact with a terminal means comprising:

a substantially rigid terminal means having an opening adapted to receive at least one wire for securement therein;

and a malleable noble metal pin adapted for sliding insertion into said opening between a sidewall thereof and said fine wire, whereby when a longitudinal force is applied to one end of said pin means radial expansion thereof occurs so as to secure said fine wire in electrical contact with said sidewall of said sidewall of said terminal means.

2. A system as claimed in claim 1 wherein said sidewall is plated with a noble metal.

3. A system as claimed in claim 2 wherein said noble metal is selected from the group consisting of gold, platinum and silver.

4. A system as claimed in claim 1 wherein said sidewall has a textured or contoured surface.

5. A system as claimed in claim 1 wherein said noble metal pin is a soft gold pin.

6. A system as claimed in claim 5 wherein said soft gold pin is preformed having a pointed longitudinal end and a recessed longitudinal end.

7. A system as claimed in claim 1 including needle-shaped means for applying said force to said longitudinal end of said pin means.

8. A system as claimed in claim 1 including a fine wire for securement in said terminal means.

9. A system as claimed in claim 8 wherein said fine wire is a platinum-iridium wire having a diameter of less than 0.003".

10. A system as claimed in claim 9 wherein said wire has a diameter of about 0.0015".

11. A method for securing a wire less than 0.003" in diameter in electrical contact with a terminal means, comprising:

(a) providing a terminal means having an opening therein of at least five times the diameter of said wire;

(b) inserting said wire into said opening;

(c) inserting a malleable noble metal pin means in said opening between a sidewall thereof and said wire; and (d) applying longitudinal pressure on one end of said noble metal pin means so as to radially expand said noble metal pin means into locking and electrical and mechanical engagement with said wire in said terminal means.

12. A method as claimed in claim 11 including providing said sidewall of said opening with a conductive surface.

13. A method as claimed in claim 12 wherein said conductive surface is electroplated gold.

14. A method as claimed in claim 11 wherein said sidewall has a textured or conoured surface.

15. A method as claimed in claim 11 including preforming said pin means with one pointed longitudinal end to facilitate insertion thereof in said opening and a second, recessed, longitudinal end as to facilitate centering of said longitudinal force thereon.

16. A method as claimed in claim 11 wherein said noble metal is selected from the group consisting of gold, silver and platinum.

17. A method as claimed in claim 16 wherein said wire is a platinum-iridium wire having a diameter in the range 0.003" to 0.0005".

18. A method as claimed in claim 11 wherein said longitudinal pressure is applied by needle-shaped means.

* * * * *